US006789325B2

(12) United States Patent
Wilson

(10) Patent No.: US 6,789,325 B2
(45) Date of Patent: Sep. 14, 2004

(54) CAN OPENER

(75) Inventor: Leslie Peter Stuart Wilson, Northamptonshire (GB)

(73) Assignee: Golden Net International Limited, SanPoKong (HK)

( * ) Notice: Subject to any disclaimer, the term of this patent is extended or adjusted under 35 U.S.C. 154(b) by 0 days.

(21) Appl. No.: 09/954,485

(22) Filed: Sep. 17, 2001

(65) Prior Publication Data

US 2002/0088127 A1 Jul. 11, 2002

(30) Foreign Application Priority Data

Sep. 21, 2000 (GB) ..... 0023039

(51) Int. Cl.[7] ..... B67B 7/48; B67B 7/74
(52) U.S. Cl. ..... 30/416; 30/433; 30/434
(58) Field of Search ..... 30/433, 434, 416, 30/417, 426

(56) References Cited

U.S. PATENT DOCUMENTS

| | | | | | |
|---|---|---|---|---|---|
| 396,555 | A | * | 1/1889 | Gilham | 30/416 |
| 896,822 | A | * | 8/1908 | Gorin | 30/434 |
| 1,848,033 | A | * | 3/1932 | Thompson | 30/416 |
| 2,008,430 | A | * | 7/1935 | Von Wolfordsdorf | 30/416 |
| 2,661,528 | A | * | 12/1953 | Coplen | 30/416 |
| 2,925,653 | A | * | 2/1960 | Stallard | 30/416 |
| 3,740,840 | A | * | 6/1973 | McLaren et al. | 30/403 |
| 4,050,155 | A | * | 9/1977 | Pitocchi | 30/400 |
| 4,831,735 | A | * | 5/1989 | Bast et al. | 30/433 |
| 5,367,776 | A | * | 11/1994 | Chong | 30/417 |
| 5,794,353 | A | * | 8/1998 | Lin | 30/418 |
| 5,946,811 | A | * | 9/1999 | Chang | 30/417 |
| 5,970,618 | A | * | 10/1999 | Kuo | 30/434 |
| 6,101,727 | A | * | 8/2000 | Chong | 30/418 |

FOREIGN PATENT DOCUMENTS

| | | |
|---|---|---|
| EP | 0 503 931 B1 | 2/1996 |
| GB | 2 161 449 A | 1/1986 |

* cited by examiner

*Primary Examiner*—Allan N. Shoap
*Assistant Examiner*—John Windmuller
(74) *Attorney, Agent, or Firm*—Westman, Champlin & Kelly, P.A.

(57) ABSTRACT

A can opener has a first and a second handle member pivotably connected to be moveable between an open disposition and a closed disposition. They can be squeezed together in one hand of the operator to rotate a drive wheel. A cutting wheel is mounted onto the first handle member. A radially facing aperture is formed through a part of said first handle member so that the drive wheel may partly protrude to engage the rim of the can and press it against the cutting wheel. The drive wheel is mounted rotatably onto a rivet which is held slideably in a slot in the main plate of the first handle member to be moveable towards and away from the cutting wheel.

8 Claims, 9 Drawing Sheets

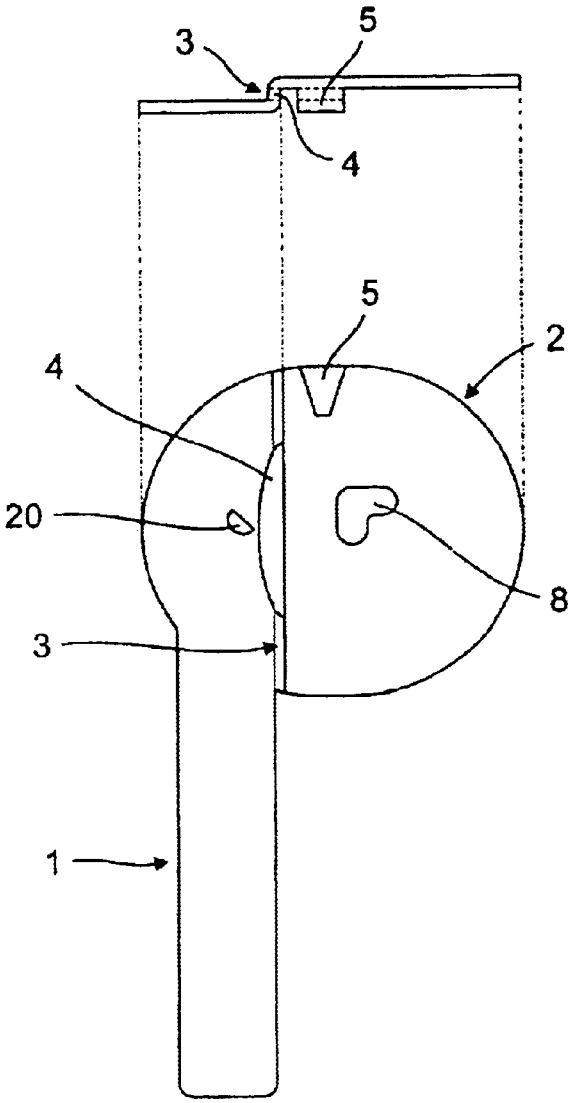
Fig. 1B
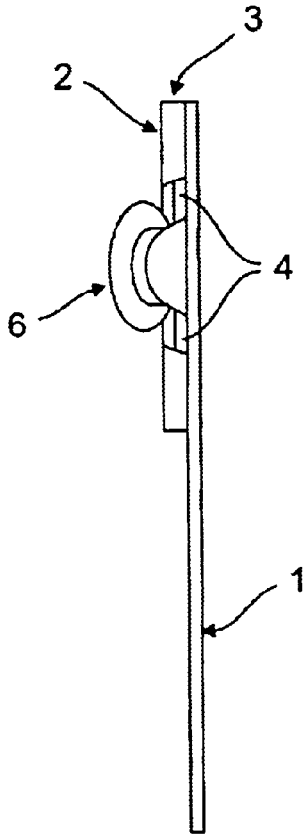
Fig. 1A
Fig. 1C

CAN OPENER

The present application claims priority of U.K. patent application Serial No. 0023039.1, filed Sep. 21, 2000, the content of which is hereby incorporated by reference in its entirety.

The present invention relates to a can opener, more particularly, but not exclusively, to a manually operable can opener of the kind having two handles pivoted together.

Several well known can openers comprise a pair of handles pivoted together, wherein one handle carries a slideably mounted or a fixed cutting wheel or a knife and the other handle carries a toothed or driving wheel, which is mounted on to a shaft which in turn is rotated by a butterfly plate or handle.

It has long been recognized that there is a need for a simple can opener, operable with one hand, and of simple construction. Application Number GB 2161449A discloses a can opener wherein the cutting element is slideably mounted so that a pair of handles may be squeezed together to cause the cutter to penetrate the can, and a further handle causes the shaft holding the drive wheel to rotate.

In this and other cited references the cutter clement is mounted in such a way that it can be moved on its mounting either slideably or by rotation on an eccentric or other means, in order to nip or penetrate the can top or wall. Other cited references also disclose a drive wheel which is mounted onto a drive shaft and then rotated by a ratchet or clutch device.

All of the above disclosures have disadvantages of cost, gearing or complexity of manufacture and use.

According to one aspect of the present invention, there is provided a can opener comprising first and second handle members pivotally connected about an axis to be moveable between an open disposition and a closed disposition, a cutting wheel or knife means being rigidly mounted onto the first handle member, a radially facing slot formed through a part of said first handle member. and a drive wheel partly protruding through said slot to engage the rim of the can and press it against the cutting wheel or knife means.

The drive wheel may be mounted rotatably onto a support shaft or rivet which is held slideably in a slot in the main plate of the first handle.

The support shaft is preferably not fixed to the drive wheel and does not supply any rotative drive to the wheel.

Preferably, said shaft does not rotate, but slides in said slot and has a suitable larger diameter head on the same side as the cutting device of said handle plate.

The first handle member is shaped as a doubly bent plate and said slot is provided in the portion thereof connecting the two bends.

The large drive wheel is thus free to rotate while lying flat on the side of the first handle plate, beyond the double bend and rotatable around the shaft, which is free to slide in the slot provided in that plate.

The second handle member may have a suitable hole and bearing material in the upper portion of the handle near to the drive wheel and which fits over the same shaft or rivet on which it freely rotates.

This second handle member may also be fitted with a ratchet device or clutch so that, when the two handles are squeezed together, the ratchet causes the drive wheel to rotate in that direction only.

A return spring may be fitted, conveniently underneath the second handle member and above the drive wheel, to cause the second handle to move apart from the first handle after the squeeze movement.

An appropriate end of this spring, where it is mounted on to the second handle, may also be used to operate said ratchet and thus avoid the use of a separate spring part for this purpose.

This spring may conveniently be of a coil spring form and may be so mounted that one end is fixed to the first handle member, and the other to the second handle member.

The spring can thus also cause the second handle member, when released from the nip or cutting position, to return to the non-nip or release position by causing the shaft to slide down its slot and, in so doing, to withdraw the drive wheel teeth from the side of the first handle member near to the cutting wheel or knife means, thereby releasing the can without further and possibly unnecessary opening of the handles.

The first handle plate may also have a sloped or conveniently shaped approach to the said slot in the double bend on the same side of said handle as the cutter, to facilitate the insertion of the unopened can into the space below the cutter and which slope can ensure the correct angle of the can to the cutter. The drive wheel teeth are at this stage below the surface of this plate to facilitate correct insertion of the can.

When the second handle is first squeezed towards the first handle after the can is in place, it presses against a cam or suitable shaped portion of the first handle plate, which provides strong leverage to lift the shaft or rivet, holding the drive wheel along its slot, so that the drive wheel teeth rise through the slot in the double plate bend and engage the rim of the can on its underside, forcing it against the fixed cutter device to penetrate the top of the can.

It will be observed that the drive wheel is already rotating due to the ratchet drive on the second handle and this rotation causes the drive wheel to move further along its slot in a direction roughly parallel to that of the axis of the first handle, due to the engagement of the hardened teeth of said wheel with the softer material of the rim of the can.

This movement causes the second handle member, the drive wheel, the spring and the ratchet system all to move in the above direction by a few millimeters, thus the tip of said second handle member becomes disengaged from the cam on the first handle and enables the full squeeze movement of the second handle member to be completed.

On releasing the spring loaded second handle at the completion of the squeeze action, it will open outwardly until the upper portion of the second handle member above its fulcrum at the shaft or rivet encounters a further cam or similar fixed object on the side of the first handle member remote from the cutter, which limits the normal opening of the handles one from the other for the next squeeze.

However, if the second handle member is pushed against the above described spring beyond this point, the drive wheel and the second handle and spring will move along the said slot in the opposite direction to that which caused the nip and cutting, and the spring will move the drive wheel away from the rim of the can and back towards the other cam, and thereby form the leverage for the nip penetration of the can.

The can may be firmly held while the two handle members are held together to facilitate the pouring of hot soup or the like from the can, which can then be discarded by opening the handles as described above.

A magnet may also be fitted at or near to the cutter to retrieve the severed lid of the can.

The use of a large drive wheel eliminates the need for gearing and the like which was tried in Application Number EP 0503931 B1 in order to reduce the number of squeezes required to open a can. A large wheel can not reasonably be used as in this example, to open a small or irregularly shaped can, or where it is desired to cut off the top of the can by cutting the cylindrical can wall. For this reason, the present invention is conveniently, but not exclusively, arranged to cut the lid or inner top surface of the can, thus leaving a safe upper edge and avoiding spillage, while the large wheel rotates around the outside lower edge of the can rim and causes a small cutter to go around the upper inside edge of the can and remove the top surface, leaving a smooth edge of the can.

It will be clear this invention is simple and has a minimal number of parts and is assemblable with only one rivet or shaft.

An embodiment of the present invention will now be more particularly described by way of example and with reference to the accompanying drawings, in which:

FIG. 1A is an elevation of a first handle from the side remote from a cutter, FIG. 1B is an end elevation of the handle of FIG. 1A, FIG. 1C is a side elevation of the handle of FIG. 1A.

Figure 2A:
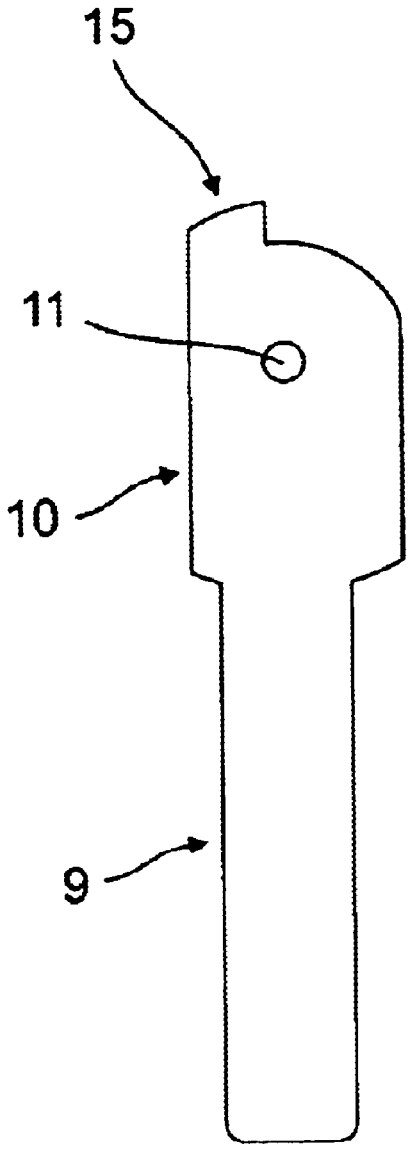
FIG. 2A is an elevation of a second handle (from the side adapted to be remote from the cutter)

Referring now to the drawings FIG. 1A shows a part of a first embodiment of the invention. A first handle 1 and a first plate 2 are shown from a side remote from a cutter wheel or knife. Handle 1 forms an integral part of the plate 2, which is formed into a double bend 3, which has a cut-away slot 4 through part of the center part of this double bend in the body of the plate 2.

A cam type device 5 is provided which may form an integral part of the plate 2 and which must be so bent into place as to engage a second handle 9 as required, but which must also clear a drive wheel 13 (See for example FIG. 6B below). A raised cam 20 is provided on a surface of the plate 2 adjacent the slot 4.

FIG. 1B is an end view of the first handle 1 and plate 2 as seen from the direction from the handle 1 towards the plate end 2 and shows in side elevation the nature of the double bend 3 and the slot 4 in that bend.

FIG. 1C is a side view of the handle 1, the plate 2, the double bend 3 in that plate and the slot 4 cut into that bend, seen from the side as an elevation from the side remote from the handle 1 and also showing a cutter wheel 6 or similar cutting knife or device, which is permanently fixed in position, but not taking into account the exact rake or angle of fixture for the sake of clarity of drawing and explanation. A slot 8 within which a shaft of a rivet 12 (See FIG. 4) slides in the assembly can opener is shown in approximately its correct position and shape.

FIG. 2A is an elevation of the second handle 9 as seen from the side remote from the cutter wheel 6 when this second handle is mounted onto the can opener. A second plate 10, which forms an integral part of the second handle 9 has a hole 11, possibly fitted with a bearing surface, to permit the passage of a shaft of the rivet 12 of FIG. 4 which can hold the drive wheel 13, the second handle and plate 9, 10 as well as a spring 14 onto the plate 2 and first handle 1, via the slot 8. The upper end of the second handle plate 10 has a curved and raised portion 15, which is designed to engage the cam device 5, in order to produce the leverage required to effect the pinch, nip or penetration of the can top or lid.

Figure 2B:
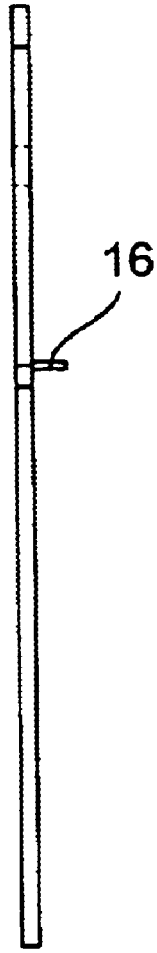
FIG. 2B is a side elevation of the second handle of FIG. 2A.
Figure 5:
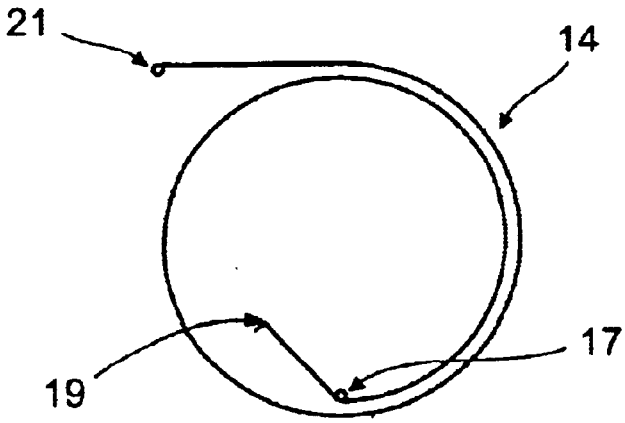
FIG. 5 is illustrates a spring used in the device.

FIG. 2B is a side view of the same second handle 9, having as a part of it the raised portion 15 and showing also a small stud or other fixing 16 suitable to hold a spring 14 as shown in FIG. 5 at its lower point onto the handle at or adjacent point 16. A loop 17 in the spring 14 of FIG. 5 may be the fixing point for the return spring 14 onto the second handle plate 10 and the protruding tail 19 or end of this fixing loop may also be used as the spring for the ratchet device which may engage the teeth of the drive wheel 13.

Figure 3A:
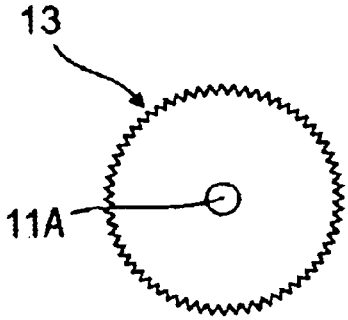
FIG. 3A is an elevation of a drive wheel.

FIG. 3A is a view of the drive wheel 13 with peripheral teeth and a suitable hole 11A, which may also have a suitable bearing material fitted to it. The teeth are cut completely around the circumference of this wheel and the wheel is hardened.

Figure 3B:
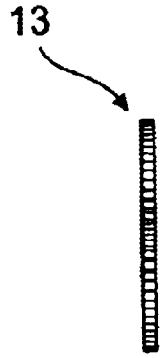
FIG. 3B is a side elevation of the drive wheel of FIG. 3A.
Figure 4:
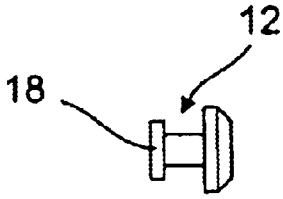
FIG. 4 is a side elevation of a rivet for assembling the device.

FIG. 3B is a side view of drive wheel 13, showing that the wheel may be the same on both sides. The drive wheel 13 may alternatively be adapted by known means to improve the ratchet or driving effects. FIG. 4 is a side view of a rivet 12 which can be used to assemble the can opener. It may have a partly flattened head 18 which slides against the side wall of the can to permit the correct angle of cutting of the can top and to retain the shaft of the rivet 12 within the slot 8 and support, but not rotate, the drive wheel 13 and to hold in place the second handle plate 10.

FIG. 5 shows the spring 14, which may perform three functions. Spring 14 may be fixed by a loop 17 onto the stud at 16 on the second handle 10. The tail or outer extremity of loop 17 may be used as the spring for the ratchet device 19. Firstly, it is the return spring for the manually squeezable can opener. Specifically, loop 17 couples to second handle plate 10 and loop 21 coupled to the first handle plate 2 to return the can opener to its open position. Secondly, a tail 19 of the loop 17 of the spring 14 may be used as the spring for the ratchet device. In such a configuration, the tail 19 will catch the teeth of drive wheel 13 preventing counter clockwise rotation of wheel 13. Thirdly, it may be used to ensure that the second handle and plate 9, 10 return to the fully released position to release the can. This is because the spring 14 will also urge handle plates 2 and 10 laterally apart causing the shaft rivet 12 to slide relative to slot 8. Referring now also to FIG. 7C, this may occur after the can has been opened by fully withdrawing the drive wheel 13 from the slot 4, and placing the raised portion 15 of the second handle plate 10 adjacent to the cam 5, after the nip has been released by this same raised portion 15 striking the raised cam 20 on the top surface of the first handle 1. The spring 14 may have a light torsional force since there is little resistance to the return opening of the second handle 9, so that when the handle strikes the cam 20 the opening or return movement will stop, unless further pressure is applied to it. If further pressure is applied, the leverage between the cam 20 and the shaft will unlock the nip and permit the spring 14 to complete its opening or return action on the second handle 9. The spring 14 may also be designed to give an outward thrust to the second handle plate 10 through its other fixing point 21. which may be on the body of the first handle and plate 1, 2, so that the second handle and plate 9, 10 return to the correct position to engage the raised portion 15 with the cam 5 on the first handle plate 2, ready for the next can and without extra and undesirable opening, thereby permitting the can opener to be used with comfort by persons with small or weakened hands.

Figure 6A:
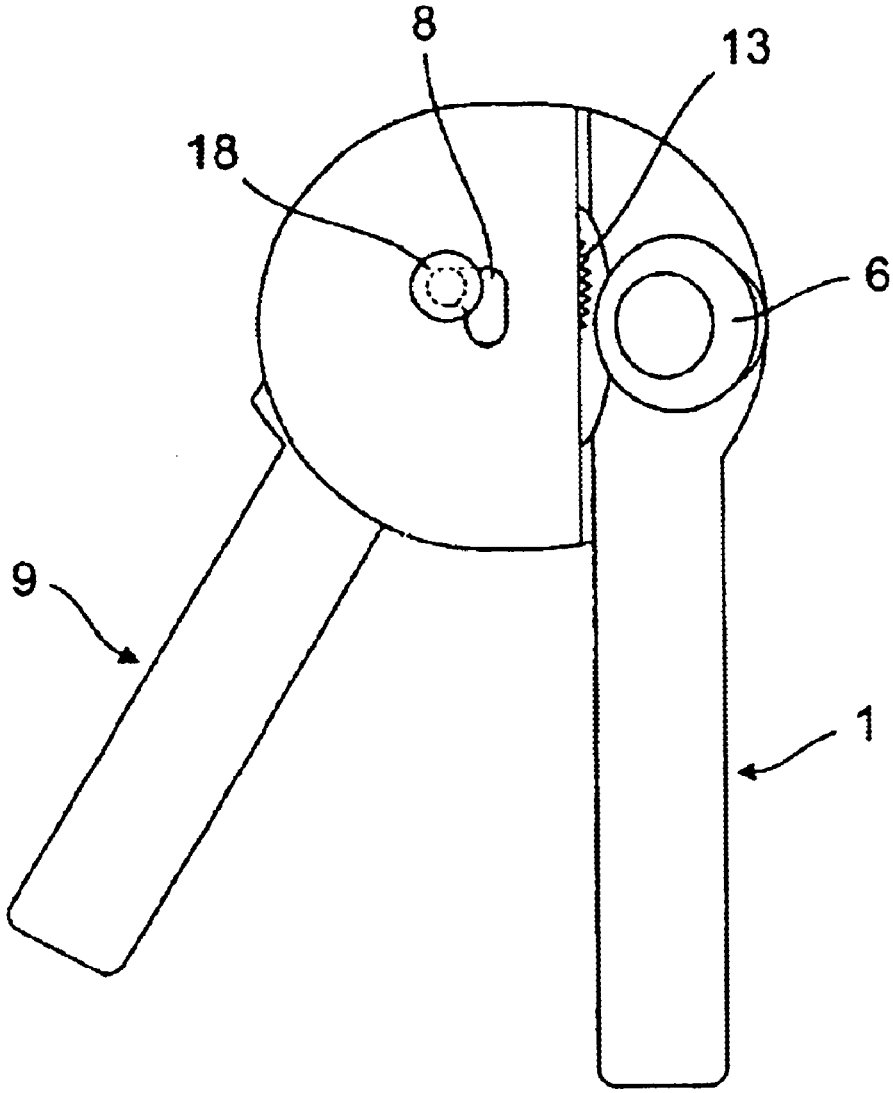
FIG. 6A is an elevation of an assembled device.

FIG. 6A is a view of the assembled can opener ready to receive a can to be opened as seen from the side from which the can is presented and where the cutter wheel can be seen. The drive wheel teeth are shown withdrawn to permit easy access for the can rim into the space below the cutter wheel or knife device.

Figure 6B:
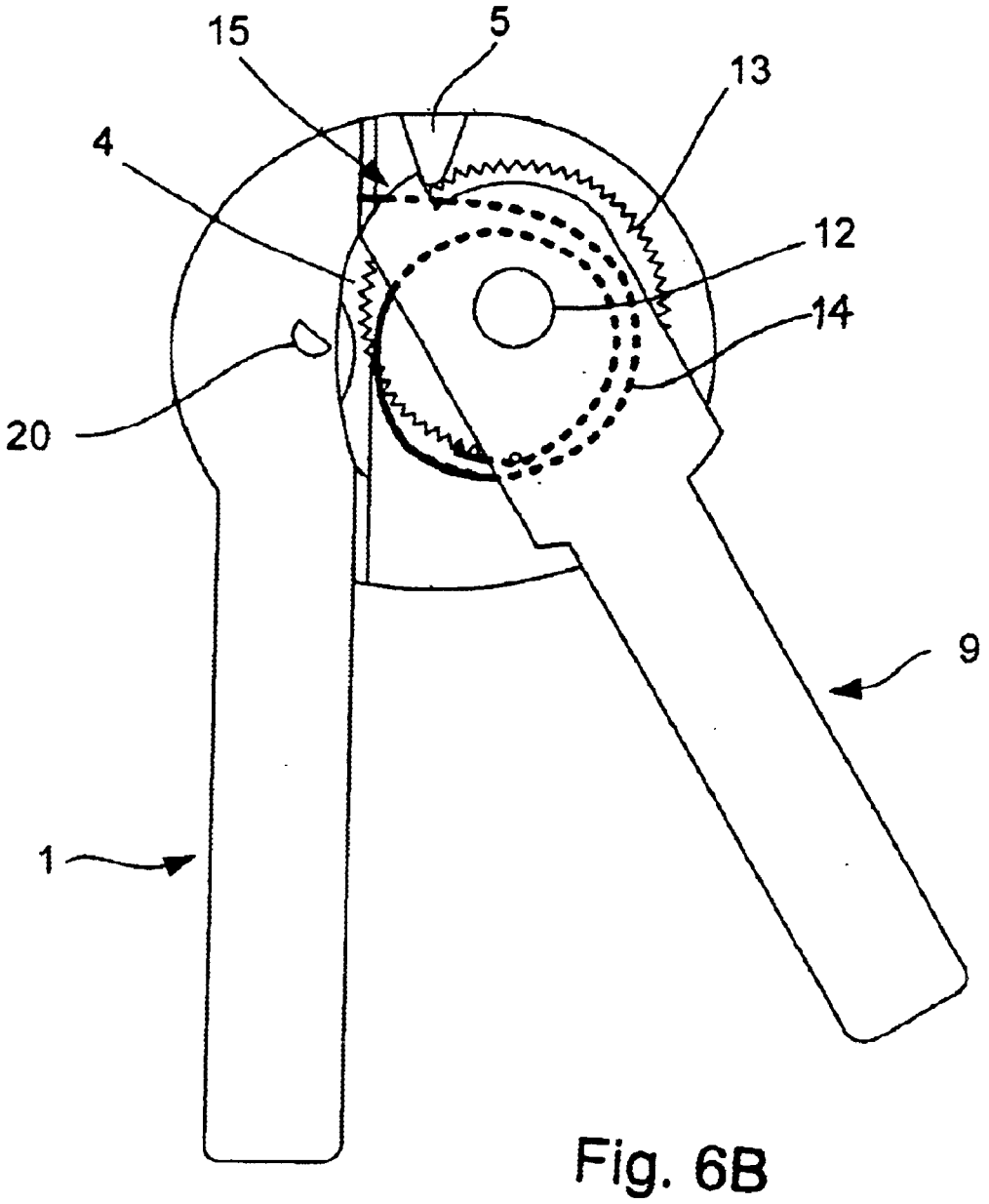
FIG. 6B is an elevation from the opposite side of the device of FIG. 6A.

FIG. 6B shows the same situation but is seen from the rear of the can opener. It will be observed that the spring 14 has moved the second handle plate 10 to a fully withdrawn position so that the drive wheel teeth are not obstructing the entrance of a new can and that the raised portion 15 of the second handle 10 is automatically engaged with the cam 5 on the first handle plate 2. The arrangement is thus ready for a first squeeze of the handles 1 and 9, which will utilize the leverage between the cam 5 and the tip of the raised portion 15 of the second handle 9 against the shaft of the rivet 12 to cause penetration of the can top by the cutter 6. As a result of the upward pressure of the drive wheel 13. (Note that the cutter 6 device does not slide or change position other than to rotate).

Figure 7A:
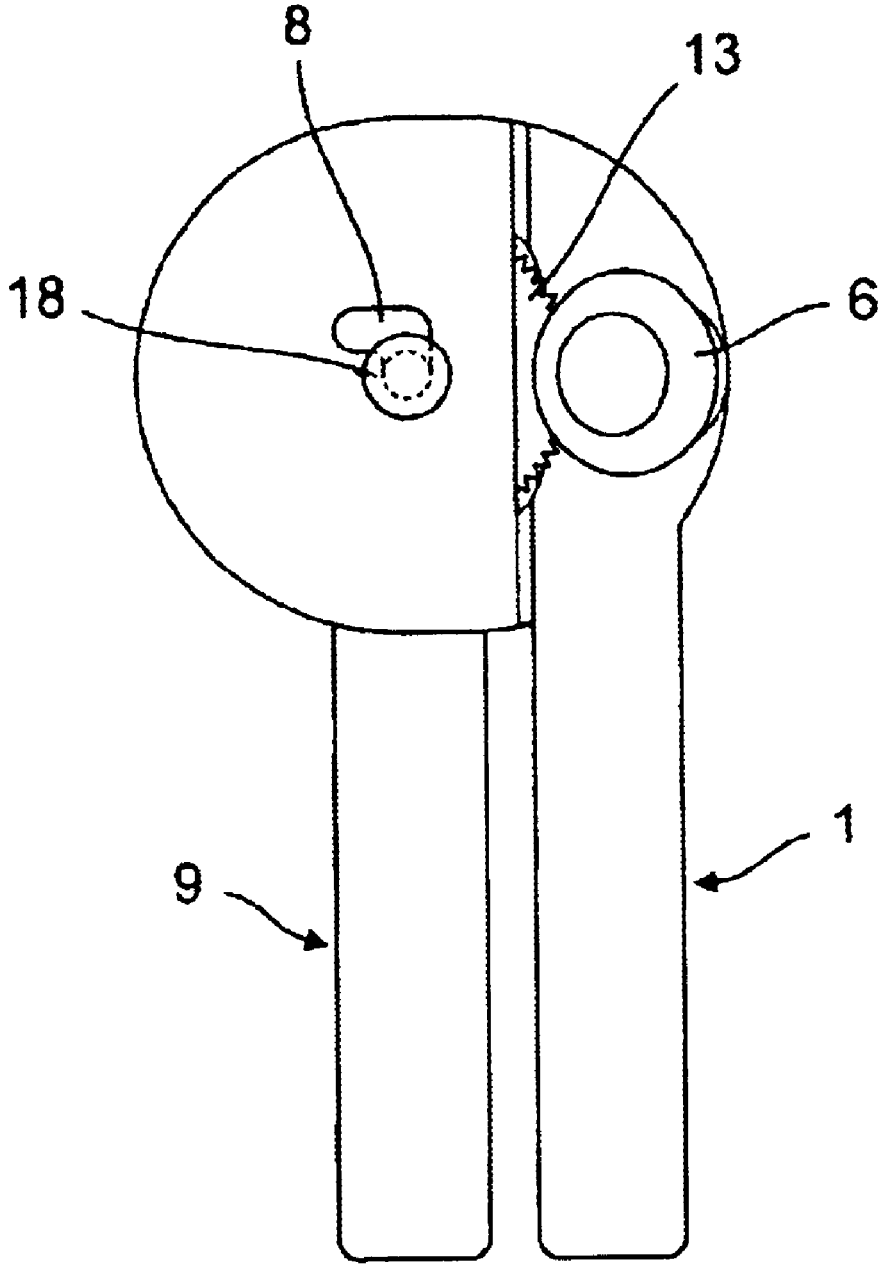
FIG. 7A is an elevation corresponding to that of FIG. 6A, but with the device in gripped condition.

FIG. 7A is a view of the assembled can opener, as it would appear as it is in the process of opening a can (the can is omitted to show the can opener more clearly). The drive wheel 13 teeth are engaged with the rim of the can on its underside and have forced the cutter 6 to penetrate the can lid while the continued squeeze of the handles 1 and 9 causes the can to rotate counter clockwise while the cutter 6 cuts the top lid off. It should be observed that the shaft of the rivet 12 is moved along the slot 8 in part by this rotation and friction caused by the drive wheel 13 and is held in that position during the return spring 14 movement prior to the next squeeze.

Figure 7B:
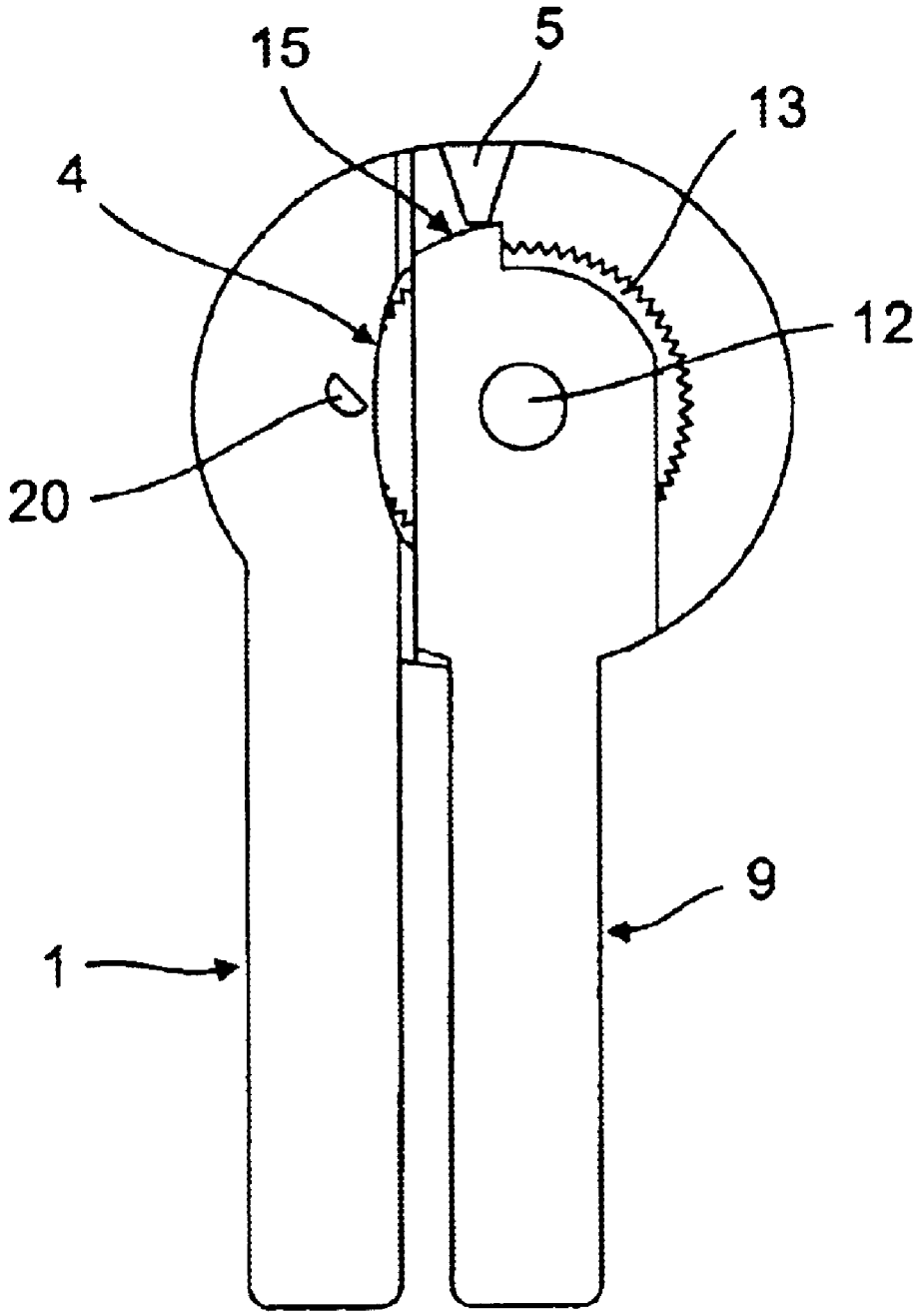
FIG. 7B is a reverse elevation of the device shown in FIG. 2A, and, FIG. 7C is an elevation of the device of FIGS. 6 and 7 in an open condition.
Figure 7C:
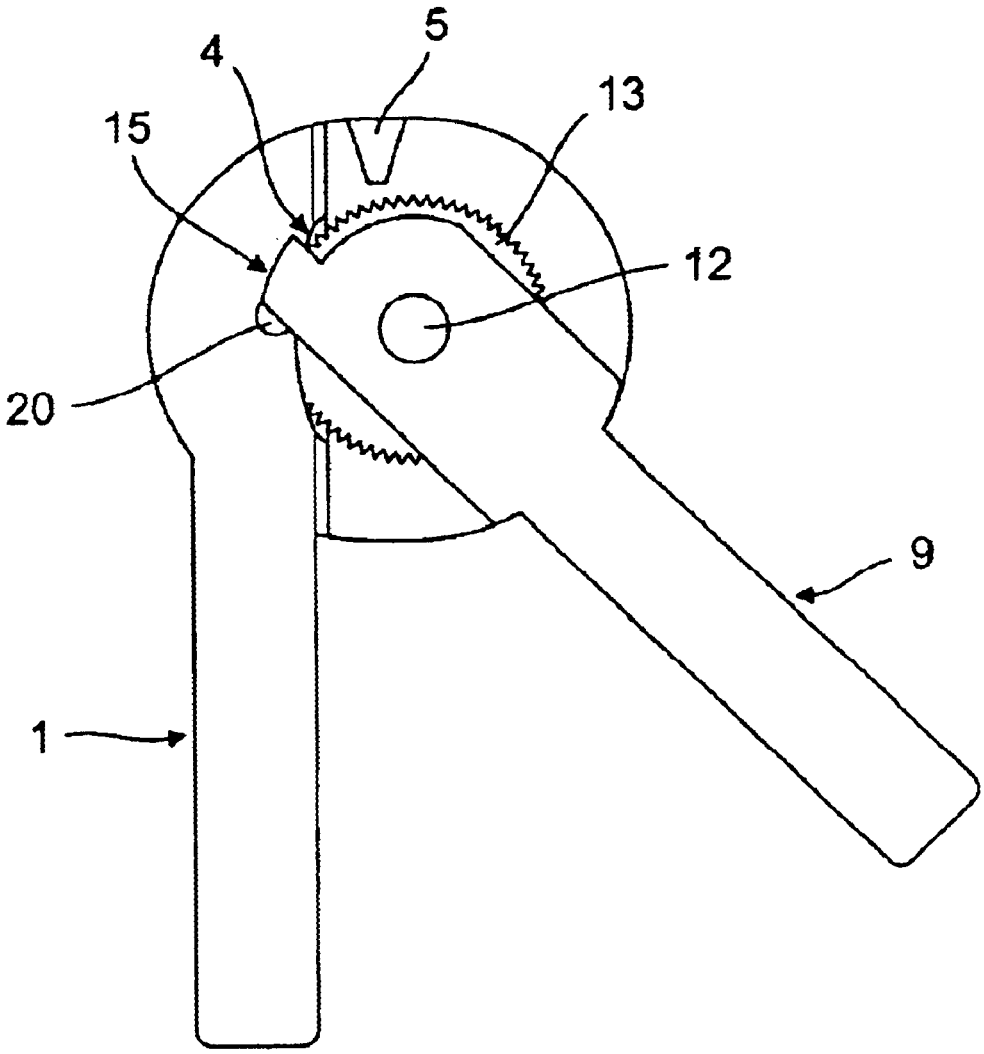
Figure 8:
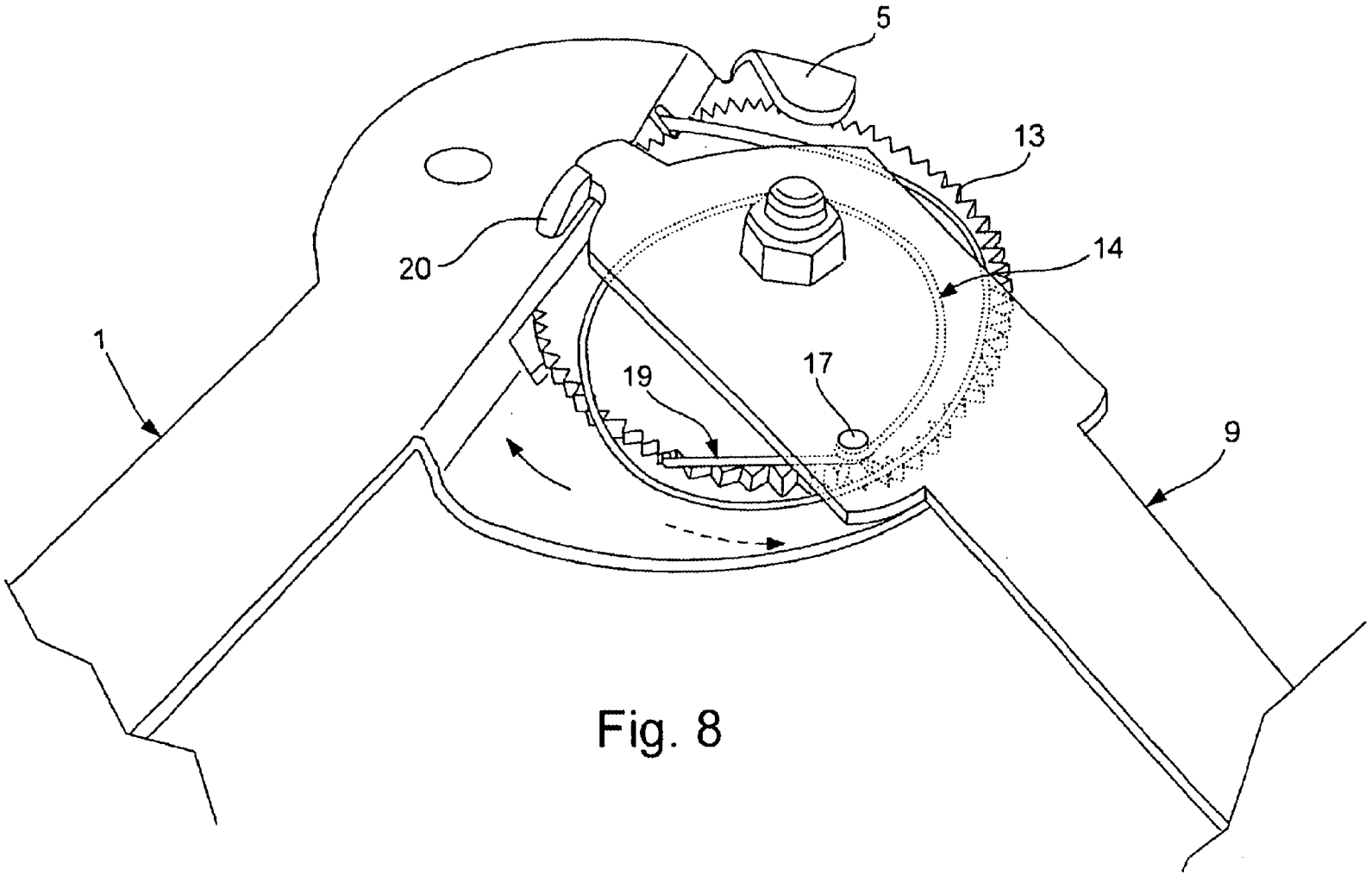
FIG. 8 is a perspective view of the device.

FIG. 7B shows the same situation as that shown in FIG. 7A but seen from the reverse side. It will be seen that the raised portion 15 of the second handle 9 is now clear of the cam 5 on the first handle plate 2. The second handle 9 is thus free to be repeatedly squeezed, then released to be returned to the cutting position by the spring 14, without touching the cam 5 again, until the can is opened and released as in FIG. 6. The ratchet device 19 is beneath the second handle and cannot thus be seen in this drawing. There may also be a spring loaded button or other device fitted between the handles in a roughly parallel attitude for storage or display.

FIG. 7C shows the assembled can opener at the end of the return spring stroke or at an opening stroke between the two handles. At this point the raised portion 15 of the second handle 10 strikes the cam 20 on the first plate 2 of the first handle and prevents further opening, for ease of operation by hand. However, if the handle 9 is forced further open, the leverage between this cam 20 and the raised portion 15 and the shaft of the rivet 12 will force the rivet 12 to move back down the slot 8 and will thus release the body of the can and return the arrangement to the position shown in FIGS. 6A and 6B.

What is claimed is:

1. A can opener comprising a first handle member and a second handle member pivotably connected one to the other to be moveable between an open disposition and a closed disposition;

a cutting means mounted to the first handle member;

a radially facing aperture formed through a part of said first handle member;

a toothed drive wheel rotatable when the first and second handle members are squeezed toward said closed disposition;

ratchet means to permit rotation of the drive wheel in one direction only;

a support shaft mounted to said second handle member and to which said drive wheel is mounted rotatably;

a slot in the first handle member, in which said support shaft is so held slideably that the drive wheel may partly protrude through said aperture to engage a rim of a can to be opened and press it against the cutting means.

2. A can opener according to claim 1, wherein the first handle member is shaped as a doubly bent plate and said aperture is provided in the portion thereof connecting the two bends.

3. A can opener according to claim 1, wherein the first handle member has a zone, adjacent said aperture and on the same side of said handle as the cutting means, to facilitate the insertion of the can to be opened into a space below the cutting means, said zone being so sloped as to ensure a correct angle of the can to the cutter whilst the drive wheel is below the surface of this plate.

4. A can opener according to claim 1, wherein the first handle member is provided with cam means to permit leverage to move the support shaft along said slot when the second handle member is initially squeezed towards the first handle member after the can is in place, so that the drive wheel teeth rise through the aperture and engage the rim of the can on its underside, forcing it against the cutting means to penetrate a top of the can to be opened.

5. A can opener according to claim 4, wherein rotation of the drive wheel via the ratchet means of the second handle member causes the drive wheel to move further along its slot in a direction generally parallel to a longitudinal axis of the first handle member, due to the engagement of the teeth of said wheel with the rim of the can.

6. A can opener according to claim 1, wherein the second handle member is configured to move apart from the first handle member, and to cause the second handle member, when released, to return to the open disposition by causing the support shaft to slide down said slot and, in so doing, to withdraw the drive wheel teeth from the cutting means, thereby releasing the can without further opening of the first and second handle members.

7. A can opener according to claim 6, wherein said rotation of the drive wheel causes the second handle member, the drive wheel, and the ratchet means all to move in order to allow the second handle member to become disengaged from the cam means and enable the second handle member to be squeezed fully to the closed disposition.

8. A can opener according to claim 7, wherein the second handle member, on release at the completion of the squeeze action is biased to open outwardly until a portion thereof encounters stop means on the side of the first handle member remote from the cutter, whereby the opening of the handles one from the other is limited.

* * * * *